United States Patent [19]

Doody

[11] 3,933,000

[45] Jan. 20, 1976

[54] TUBULAR REGENERATOR FOR A CRYOGENIC REFRIGERATOR

[75] Inventor: Richard D. Doody, Culver City, Calif.

[73] Assignee: The United States of America as represented by the Secretary of the Air Force, Washington, D.C.

[22] Filed: Feb. 6, 1975

[21] Appl. No.: 547,664

[52] U.S. Cl. ..... 62/6; 165/10

[51] Int. Cl.[2] ..... F25B 9/00

[58] Field of Search ..... 62/6; 165/10

[56] References Cited

UNITED STATES PATENTS

| | | | |
|---|---|---|---|
| 1,460,677 | 7/1923 | Lundgaard | 165/10 |
| 2,833,523 | 5/1958 | Den Haan | 165/10 |
| 3,413,802 | 12/1968 | Cowans | 62/6 |

*Primary Examiner*—William J. Wye

*Attorney, Agent, or Firm*—Joseph E. Rusz; Richard J. Killoren

[57] ABSTRACT

The hot cylinder for a Vuilleumier cycle cryogenic refrigerator having an annular liner positioned between the hot displacer and the hot-cylinder wall with a plurality of stainless steel tubes in the space between the liner and the hot-cylinder wall to form a hot regenerator. The liner axially supports the tubes and has air flow notches at the top and bottom thereof. The gas flows through the tubes and through the spaces between the tubes. An annular seal is provided between the hot displacer and the annular liner.

3 Claims, 5 Drawing Figures

TUBULAR REGENERATOR FOR A CRYOGENIC REFRIGERATOR

RIGHTS OF THE GOVERNMENT

The invention described herein may be manufactured and used by or for the Government of the United States for all governmental purposes without the payment of any royalty.

BACKGROUND OF THE INVENTION

The invention relates to a hot regenerator for use in a cryogenic refrigerator of the type described in the patent to Vuilleumier, U.S. Pat. No. 1,275,507. Various internal and external hot regenerators have been used with cryogenic refrigerators using the Vuilleumier cycle. The regenerator is a matrix having a high ratio of surface area to volume. One type of prior art regenerator uses a fine mesh screen. These have been found to result in excessive hot regenerator losses. The gas path between the hot displacer and the hot cylinder wall has been used as a regenerator path. However, nonuniform gas flow paths produce regenerator losses and it has been very difficult to maintain a uniform gas flow path between the hot displacer and hot cylinder.

BRIEF SUMMARY OF THE INVENTION

According to this invention, an annular liner is positioned between the hot displacer and the hot cylinder. A plurality of parallel stainless steel tubular members are located between the annular liner and the hot cylinder to form a regenerator wherein the gas flows through the tubes and through the approximately triangular areas between the tubes. A piston seal at the base of the hot displacer prevents leakage around the hot regenerator. The annular liner secures the tubes in their axial position.

IN THE DRAWINGS

DETAILED DESCRIPTION OF THE INVENTION

Figure 1:
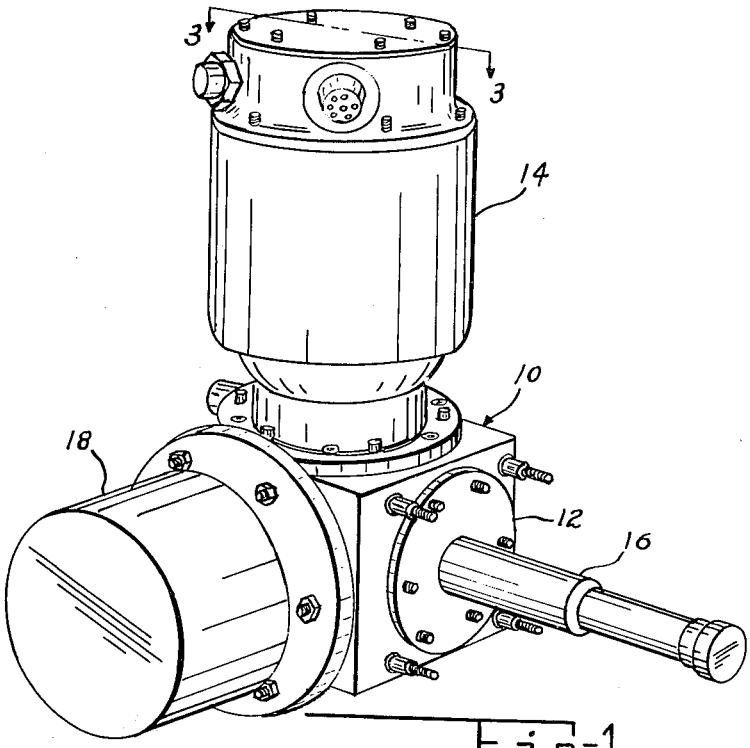
FIG. 1 is a perspective view of a two-stage Vuilleumier cycle cryogenic refrigerator with which the regenerator of the invention is used.

Reference is now made to FIG. 1 of the drawing which shows a two stage Vuilleumier cycle cryogenic refrigerator 10 having a crankcase 12, a hot cylinder 14, a cold cylinder 16 and a driving motor 18.

Figure 2:
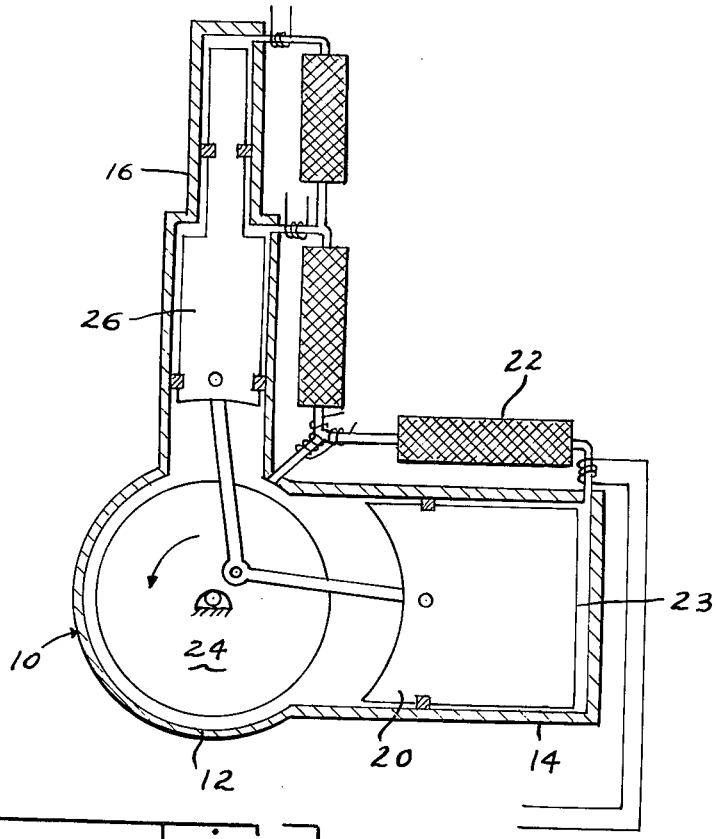
FIG. 2 is a schematic illustration of a conventional two stage Vuilleumier cycle cryogenic refrigerator.

As shown in FIG. 2, the motor drives a hot displacer 20 in the hot cylinder 14 with a hot regenerator 22 interconnecting the hot volume, at the end 23 of the hot displacer 20, and the crankcase chamber 24.

The motor also drives the cold displacer 26 in the cold cylinder 16.

Figure 3:
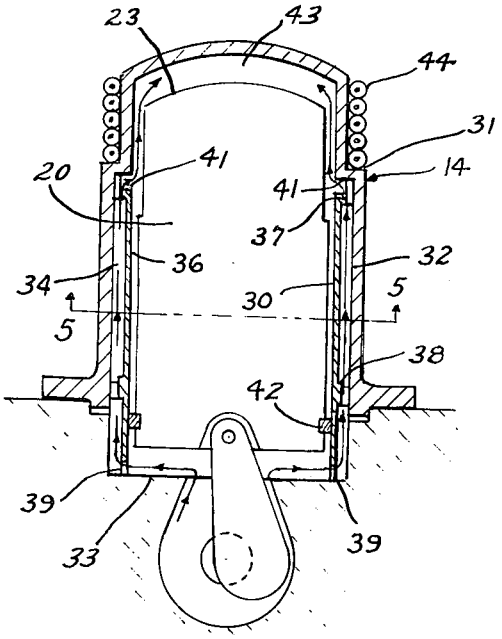
FIG. 3 is a partially schematic sectional view of the hot cylinder of the device of FIG. 1 along the line 3—3.
Figure 4:
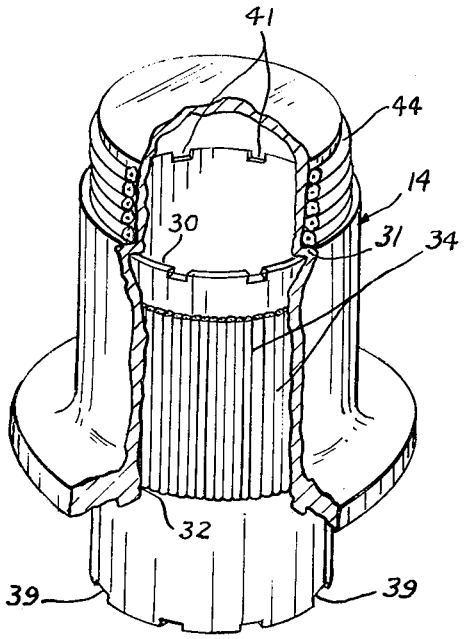
FIG. 4 is a partially cut away schematic illustration of the hot cylinder of FIG. 1 with the regenerator of the invention.
Figure 5:
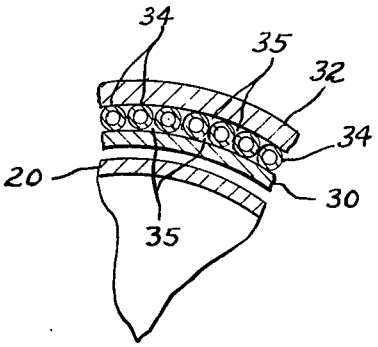
FIG. 5 is an enlarged partially cut away sectional view of the regenerator of the invention, along the line 5—5 of FIG. 3.

As shown in FIGS. 3–5, the hot cylinder 14 has an annular liner 30 spaced from the hot-cylinder wall 32 with a plurality of stainless steel tubes 34 surrounding the liner 30 and positioned between the liner 30 and the wall 32. The hot cylinder wall has a step 31 for holding the liner in place against the crankcase wall 33. The liner 30 and wall 32 are made of the same material in order that the two elements will have equal thermal expansion. In one device constructed, the material is Iconel 718 and the hot cylinder wall is 4 inches long with an inside diameter of about 2 inches. The tubes 34 are about two inches long with an inside diameter of 0.012 inch and an outside diameter of 0.022 inch. The radial dimension of the annular space between the liner and the hot-cylinder wall is about 0.024 inch. The gas, which in the device constructed is helium, flows through the tubes 34 and through the approximately triangular spaces 35 formed between the tubes, as shown in FIG. 5. The liner has an annular channel 36 with end walls 37 and 38 for securing the tubes in their axial position. The liner 30 has slots 39 at the base for gas flow from the crankcase to the tubes 34 and slots 41 at the top for gas flow from the tubes 34 into the hot volume 43 at the end 23 of the hot displacer 20.

An annular seal 42 at the base of the hot displacer 20 prevents leakage around the hot regenerator in the space between the liner 30 and the hot displacer 20. A heater element 44 is wound around the end of the hot cylinder 20.

In the operation of the device of the invention, the hot cylinder functions in the same manner as prior art cryogenic refrigerators using the Vuilleumier cycle. As the hot displacer moves away from the crankcase, the gas passes from the hot end of the hot cylinder through notches 41, then through the tubes 34 and spaces 35 and then notches 39 into the crankcase chamber 24. The regenerator includes the tubes 34 and the walls of liner 30 and the wall of hot cylinder wall 32. As the gas passes from the hot end of the hot cylinder through the regenerator, the regenerator removes heat energy from the gas and stores it in the tubes 34 and the liner and hot cylinder wall. This heat energy is returned to the gas as it passes from the crankcase through the regenerator to the hot end of the hot cylinder as the hot displacer moves toward the crankcase chamber 24. The seal 42 prevents the flow of gas in the space between the hot displacer 20 and the liner 30.

There is thus provided a hot cylinder for a Vuilleumier cycle cryogenic refrigerator with an improved regenerator which reduces the hot regenerator losses.

I claim:

1. A hot cylinder for a cryogenic refrigerator having a hot displacer in the hot cylinder; a cold cylinder inclosing a cold displacer; a crankcase connected to the hot cylinder and the cold cylinder, a motor for moving the hot displacer and the cold displacer and a heater for said hot cylinder comprising: a cylindrical wall member adapted to be secured to said crankcase; an annular liner member positioned between the hot displacer and said wall member and spaced a predetermined distance from said wall member; a plurality of elongated tubular members in the space between the wall member and the liner member; said liner member including means for axially positioning the tubular members; means for providing a seal between said hot displacer and said liner member; said liner member including means for providing a gas flow path between the crankcase through said tubular members into a hot volume adjacent the heater in the hot cylinder.

2. The device as recited in claim 1 wherein said means for axially positioning the tubular member is an annular channel in the outer wall of the annular liner.

3. The device as recited in claim 2 wherein said cylindrical wall member includes an offset for retaining said liner in place against the wall of said crankcase; said means for providing a gas flow path from the crankcase through said tubular members and into the hot volume includes a plurality of notches in the liner adjacent the crankcase and a plurality of notches in the liner adjacent the offset in the cylindrical wall member.

* * * * *